United States Patent [19]

Carmen

[11] 4,000,570

[45] Jan. 4, 1977

[54] IDENTIFICATION CARD HOLDER

[76] Inventor: Norman Carmen, 4101 Powder Mill Road, Beltsville, Md. 20705

[22] Filed: Sept. 9, 1975

[21] Appl. No.: 611,714

[52] U.S. Cl. ..... 40/1.5; 40/24

[51] Int. Cl.[2] ..... A44C 3/00

[58] Field of Search ..... 40/1.5, 1.6, 20, 25, 40/26, 24

[56] References Cited

UNITED STATES PATENTS

| | | | |
|---|---|---|---|
| 1,005,894 | 10/1911 | Senseman | 40/20 R |
| 2,145,296 | 1/1939 | Draper et al. | 40/1.5 |
| 2,618,086 | 11/1952 | Komorous | 40/1.5 |
| 2,799,104 | 7/1957 | Griesinger | 40/2 R |
| 3,559,318 | 2/1971 | Sitzberger | 40/1.5 |

*Primary Examiner*—G.E. McNeill
*Assistant Examiner*—Wenceslao J. Contreras
*Attorney, Agent, or Firm*—Ulle C. Linton

[57] ABSTRACT

An identification card holder in the form of a transparent plastic envelope open only at one end whereby an identification card can be inserted in and viewed through the holder and a safety pin having the pointed end portion extending through openings in the rear of said envelope for attachment to clothing of a user thereof and a method of forming said holders.

4 Claims, 5 Drawing Figures

I.D. CARD
A

IDENTIFICATION CARD HOLDER

BACKGROUND OF THE INVENTION

Identification card holders using a transparent plastic envelope and a safety pin for attaching the envelope to a users clothing are known and such envelopes have openings through which the pointed end of the safety pins are inserted and then said safety pins are closed with the pointed end in a guard which requires opening the safety pin, inserting through the envelope openings and then closing the safety pin which requires considerable time and labor when assemblying large quantities of the holders.

Also articles holders in the form of an envelope with a closure flap and openings for receiving a safety pin are known as for example the article holder shown in U.S. Pat. No. 2,630,640, but these holders also require the three manual steps described hereinbefore for assembly.

The present invention provides a plastic identification holder with safety pin which can be assembled is less time and with less labor than known holders thus reducing the cost thereof.

BRIEF SUMMARY OF THE INVENTION

A transparent plastic envelope open at one edge for receiving an identification card, has a flap initially separated at its top and sides from the rear side of the envelope whereby a closed safety pin can have said flap inserted through the safety pin and the top of the flap attached to the top edge of the front side of the envelope whereby a holder is quickly provided ready for use.

BRIEF DESCRIPTION OF THE DRAWING

In the accompanying drawing.

DETAILED DESCRIPTION

Figures 1, 2, 3, 4, 5:
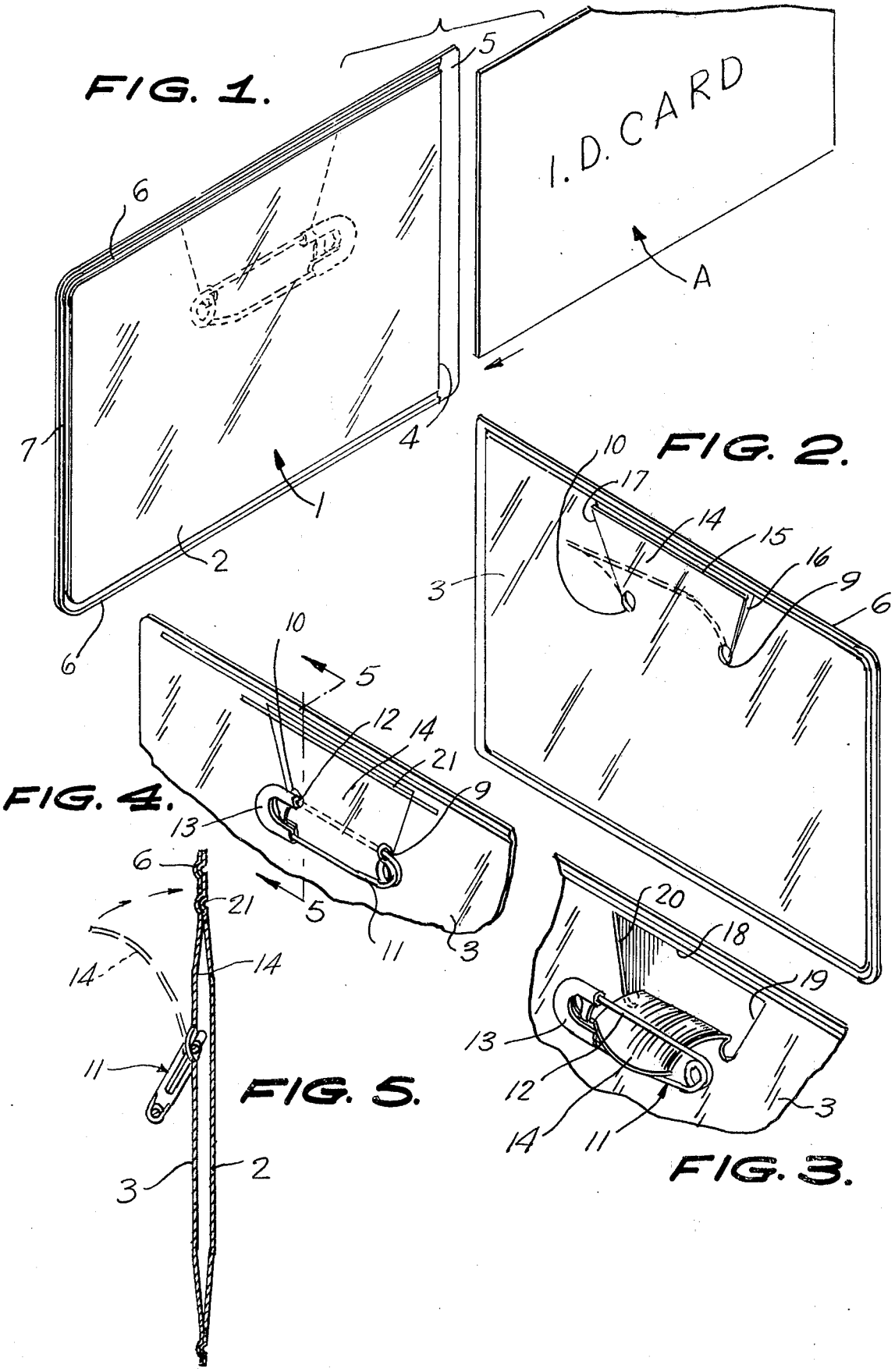
FIG. 1 is an exploded perspective view of the present holder with a card positioned for insertion therein.
FIG. 2 is a rear perspective view of the holder before assembly with a safety pin.
FIG. 3 is a partial perspective view of the top rear portion of the holder showing the safety pin being assembled thereto.
FIG. 4 is a partial perspective view of the top rear portion of the completed holder; and, FIG. 5 is a cross-sectional view taken on line 5—5 of FIG. 4.

Referring now more in detail to the accompanying drawing wherein like and corresponding parts are indicated by the same reference characters, 1 generally indicates a transparent envelope of heat sealable plastic material having a front 2 and back 3. Front 2 is shorter than back 3 so that front edge 4 is spaced inwardly from back edge portion 5 providing a side opening into which an identificaion card A can be inserted into the envelope and be viewed therethrough.

The top edges 6, end edges 7 and bottom edges 8 of said front 2 and back 3 are heat sealed together.

Back 3 has a pair of spaced apart openings 9 and 10 through which the pointed end leg 12 of a conventional safety pin 11 extends in the completed holder. Safety pin 11 is closed with the pointed end in guard 13 until opened by a user of the holder for attachment to clothing in the use of the holder.

A flap 14 is initially provided by separating the top 15 and inwardly tapering sides 16 and 17 of said flap from the material of back 3. Said sides 16 and 17 extend from just below sealed edge 6 of the envelope down and inwardly to openings 9 and 10 leaving a base of the flap 14 between said openings which remains a part of the material of back 3.

Said flap 14 can be formed before back 3 is attached to front 2 as when back 3 alone is being produced or back 3 can be slit to provide top 15 and sides 16 and 17 by slitting back 3 before or after assembly to front 2.

Thereafter the closed safety pin 11 is assembled to the holder by inserting flap 14 between the legs of said safety pin as shown in FIG. 3. Flap 14 can be partially bent into a lateral arc as shown to facilitate the assembly. Flap 14 is then reinserted in the opening 18–20 of back 3 caused by the separation of top 15 and sides 16 and 17 from back 3 and edge 15 heat sealed or otherwise fastened to front 2 at the line 21 as shown in FIGS. 4 and 5 completing the assembly of the present holder ready for receiving card A as shown in FIG. 1.

However top 15 does not have to be sealed to front 2, as openings 9 and 10 are within flap 14 and thus will hold the safety pin 11 in use on clothing.

A user can open pin 11 and insert pointed end leg 12 through his or others clothing and thereafter close the pin whereby front 2 will be seen and the indicia on card A readily view threrethrough.

I claim:

1. An identification card holder comprising an envelope having a transparent front, a back partially attached to said front along corresponding edges thereof with an opening between said front and back for receiving a card therethrough, said back having a pair of openings in an internal portion and a flap portion extending from said openings to an edge of said back, said flap having an outer edge affixed to an edge of said front, and a safety pin having one leg thereof extending through said back openings.

2. An identification card holder as claimed in claim 1 wherein said flap has sides diverging outwardly from said holes to said flap outer edge.

3. An identification card holder as claimed in claim 1 wherein said flap has side edges separated from said back and said back openings positioned between said flap side edges and each flap side edge extends to one of said openings.

4. A method of forming an identification card holder consisting in separately forming the back and front of an envelope from transparent plastic material, forming a flap from said back with a pair of holes at the base of said flap with side edges of said flap diverging from said holes to a top edge of said flap, inserting said flap through a closed safety pin to a position wherein a leg of the safety pin extends through said holes, attaching said back and front partially along corresponding edges thereof and at the same time attaching said flap top edge to one edge of said front.

* * * * *